United States Patent [19]

Cipris et al.

[11] 4,131,521

[45] Dec. 26, 1978

[54] ELECTROCHEMICAL SYNTHESIS OF ORGANIC CARBONATES

[75] Inventors: Divna Cipris; Irving L. Mador, both of Morristown, N.J.

[73] Assignee: Allied Chemical Corporation, Morris Township, Morris County, N.J.

[21] Appl. No.: 848,976

[22] Filed: Nov. 7, 1977

[51] Int. Cl.[2] ..... C25B 3/02

[52] U.S. Cl. ..... 204/59 R; 204/78

[58] Field of Search ..... 204/59 R, 72, 78, 79, 204/80

[56] References Cited

U.S. PATENT DOCUMENTS

| | | | |
|---|---|---|---|
| 3,397,225 | 8/1968 | Fenton | 204/59 R X |
| 3,397,226 | 8/1968 | Fenton | 204/59 R X |

*Primary Examiner*—F.C. Edmundson

*Attorney, Agent, or Firm*—Robert J. North; Robert A. Harman

[57] ABSTRACT

A process is described for the electrochemical synthesis of organic carbonates, such as dimethyl carbonate and ethylene carbonate, useful as industrial solvents for polymers and resins, which comprises electrolyzing a liquid medium containing a nonfluoride halide-containing electrolyte and a paraffinic monohydric or 1,2-dihydric alcohol. The non-fluoride halide-containing electrolyte is present in an amount of about 0.01 to 10 weight percent of the alcohol used, and the electrolysis is conducted by passing a direct current through the liquid medium at a temperature below its boiling point and under a carbon monoxide atmosphere at a pressure of about 1 to 350 atmospheres.

18 Claims, No Drawings

ELECTROCHEMICAL SYNTHESIS OF ORGANIC CARBONATES

BACKGROUND OF THE INVENTION

1. Field of the Invention

This invention relates to an electrochemical process for synthesizing organic carbonates by electrolyzing a liquid medium containing a non-fluoride halide-containing electrolyte and a paraffinic monohydric or 1,2-dihydric alcohol under a carbon monoxide atmosphere.

2. Brief Description of the Prior Art

Organic carbonates, such as dimethyl carbonate, ethyl carbonate, ethylene carbonate and propylene carbonate, are a useful class of solvents and reagents. They find use in many industrial applications such as solvents for polymers and resins in processing operations, and in the synthesis of pharmaceuticals, rubber chemicals, textile finishing agents and polycarbonate resins.

Conventional methods for preparation of organic carbonates usually employ the reaction of phosgene and an alcohol at elevated temperature, as described in the Encyclopedia of Chemical Technology, Volume 4, page 391, by Kirk-Othmer (Wiley, New York, 1964).

Other known methods for producing carbonates, including the following, employ a catalyst salt for participating in a redox reaction with carbon monoxide.

U.S. Pat. No. 3,114,762 (1963) describes a process for producing carbonates by reacting carbon monoxide with a monohydric alcohol in the presence of a metal salt such as palladium bromide.

U.S. Pat. No. 3,846,468 (1974) describes a process for producing carbonates by reacting alcohol with carbon monoxide in the presence of an organometallic cuprous chloride complex.

The reference, Kondo et al., Bull. Chem. Soc. Japan, Vol. 48 (1), pp. 108–111, (1975), describes a process for producing organic carbonates by reacting alkoxides with carbon monoxide and oxygen in the presence of a selenium catalyst.

However, the above processes either require the use of large quantities of toxic phosgene or expensive metal catalyst salts, which after use are either discarded or require regeneration by a separate oxidation process for recycle.

What is desired and what the prior art does not provide is a convenient, economical process for producing organic carbonates without resort to the use of large quantities of phosgene or the use of expensive metal catalyst salts.

Electrochemical oxidation reactions have some distinct advantages over "normal" solution oxidation reactions in which a homogenous or heterogenous catalyst is used. The anode in an electrochemical reaction serves as an electron acceptor for negatively charged species in solution, thus promoting the oxidation reaction and obviating the need for oxidation catalyst salts. Furthermore, reduced species in solution can be conveniently regenerated at the anode for further participation in the oxidation reaction.

Electrochemical oxidations involving an alcohol and carbon monoxide are known.

The electrolytic carbonylation of arylated alpha olefins to produce alpha, beta-unsaturated esters, using carbon monoxide, is described in Bull. Chem. Soc. Japan, Volume 38, page 21–22 (1965). The process involves electrolyzing an alcoholic solution of an arylated alpha olefin saturated with carbon monoxide, using sodium methoxide as an electrolyte.

Anodic oxidations of methanol and ethanol are described in J. Electroanal. Chem. Vol. 31, pp. 265–267 (1971), using different electrolytes such as sodium perchlorate, tetrabutylammonium fluoride, and sodium methoxide. The products of the oxidations were found to be ethers and acetals of the corresponding starting alcohols.

The anodic oxidation of anhydrous methanol is described in J. Electrochem. Soc., Vol. 123, pp. 818–823 (1976). Anodic oxidation was carried out using sodium methoxide as the electrolyte. Under anhydrous conditions, formaldehyde was the major product, and with added water to the system, formate ion was produced.

The reference, J. Electrochem. Soc., Vol. 124, pp. 1177–1184 (1977), describes the anodic oxidation of methanol and ethanol in the presence of sodium iodide as electrolyte. The electrolysis of methanol produced primarily methyl formate and the electrolysis of ethanol produced primarily ethyl formate, along with ethyl methyl ether, methyl iodide and a trace of acetaldehyde.

However, none of the aforementioned references describe or suggest the possibility of forming organic carbonates by an electrochemical process.

We have unexpectedly found that by passing a direct electric current through a liquid medium containing a non-fluoride halide-containing electrolyte and a paraffinic monohydric or 1,2-dihydric alcohol, under a carbon monoxide atmosphere, organic carbonates are formed. The halide ion of the electrolyte, preferably being bromide ion, is essential for formation of the carbonates, and is usually used in an amount of about 0.01 to 10 weight percent, based on the amount of said alcohol used. The electrolysis is usually conducted in the temperature range from about 0° C. to 100° C., and under a carbon monoxide atmosphere at a pressure of about 1 to 350 atmospheres. The halide ion is believed to be continuously regenerated in the process, and thus the need for large amounts of toxic phosgene or expensive metal catalysts, as used in the prior art, is obviated.

SUMMARY OF THE INVENTION

In accordance with this invention, there is provided a process for preparing non-polymeric organic carbonates comprising passing a direct electric current between an anode and cathode immersed in liquid medium consisting essentially of a non-fluoride halide-containing electrolyte and a paraffinic monohydric or 1,2-dihydric alcohol, or mixture thereof, at a temperature below the boiling point of the liquid medium and under an atmosphere consisting essentially of carbon monoxide.

DESCRIPTION OF THE INVENTION AND PREFERRED EMBODIMENTS

The novelty of this invention is the discovery that the presence of a catalytic amount of non-fluoride halide-containing electrolyte, during the electrolysis of a liquid medium containing a paraffinic monohydric or 1,2-dihydric alcohol, under a carbon monoxide atmosphere, is instrumental in producing organic carbonates from the corresponding alcohols. We believe that the overall process can be represented by the following equation:

$$2ROH + CO \longrightarrow \underset{\text{carbonate}}{RO{-}CO{-}OR} + H_2$$

where R is an alkyl radical representing an alcohol, including monohydric and 1,2-dihydric forms. It is also believed that halide ion participates in an anodic oxidation to form elemental halogen which then catalyzes the reaction between one mole of carbon monoxide and two moles of alcohol to produce one mole of an organic carbonate and one mole of hydrogen. The elemental halogen is believed to be converted, after catalysis, to halide ion which is then available for anodic oxidation to initiate the cycle again. The overall stoichiometry of the process is thus assumed to require 2 moles of alcohol per mole of carbon monoxide and a catalytic amount of non-fluoride halide ion.

The reaction conditions are maintained such that only hydrogen is produced at the cathode to eliminate the possibility of reducing any formed products in the reaction medium. Also, fluoride ion is not believed to be applicable in the invention since it possesses a high anodic oxidation potential which may lead to undesirable side reactions prior to desired carbonate formation under the reaction conditions.

Organic carbonates which can be produced by the invention process and are non-polymeric include those of the following formulas:

1) RO—CO—OR' and

1) RO—CO—OR' and

2) 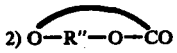

where R and R' are independently selected from linear or branched $C_1$–$C_{18}$ alkyl, and R'' is $—CH_2—CH_2—$ or $—CH_2—CH(CH_3)—$, wherein R and R' may contain other substituents which are not oxidized or reduced under the conditions of the reaction such as covalently bond halogen, linear or branched $C_1$–$C_4$ alkoxy and linear or branched $C_1$–$C_4$ alkyl. Symmetrical and unsymmetrical organic carbonates may be prepared by the use of a mixture of two different alcohols.

Representative examples of organic carbonates that can be produced from the invention include dimethyl, diethyl, dipropyl, diisopropyl, dibutyl, dipentyl, di-t-butyl, didecyl, methylethyl, ethylene, 1,2-propylene carbonate and the like. Preferred carbonates produced in the process are dimethyl, diethyl, ethylene and 1,2-propylene carbonates.

Paraffinic monohydric alcohols which are useful in the process include those containing a linear or branched $C_1$–$C_{18}$ alkyl radical directly attached to the oxygen of the single alcohol group in the compound. Representative examples include methyl, ethyl, propyl, isopropyl, butyl, pentyl, t-butyl, decyl, hexadecyl, octadecyl and the like. Preferred monohydric alcohols in the process are methyl and ethyl alcohols. In addition, the alcohols may contain other substituents on the linear or branched $C_1$–$C_{18}$ paraffinic radicals, which are not oxidized or reduced under the conditions of the reaction. Such substituents include covalently bond halogen, linear or branched $C_1$–$C_4$ alkoxy and linear or branched $C_1$–$C_4$ alkyl. Representative examples of such groups are chloro, bromo, methoxy, ethoxy, methyl, ethyl, t-butyl and the like.

1,2-Dihydric paraffinic alcohols, also known as 1,2-glycols, useful in the process include ethylene glycol and 1,2-propylene glycol.

In the process, the liquid medium can be a solution of carbon monoxide and a non-fluoride halide-containing electrolyte in a paraffinic monohydric or 1,2-dihydric alcohol, wherein the alcohol is a liquid under the reaction conditions. Where the alcohol is a solid at the temperature conditions employed, such as 1-octadecanol (stearyl alcohol) having a melting point of 58°–60° C., an inert solvent, having good solvency for the alcohol, may be additionally used as part of the liquid medium. The solvent should be inert to oxidation or reduction under the reaction conditions and should be able to dissolve at least about one part alcohol in 10 parts of solvent at the reaction temperature employed. Usually, a minimum amount of solvent is used to dissolve the alcohol. Representative examples of solvents include p-dioxane, diethyl ether, tetrahydrofuran, dimethyl carbonate, ethylene carbonate and the like.

The liquid medium can also contain up to about 10 percent by weight of water in the process. It is preferred to conduct the process under substantially anhydrous conditions.

Non-fluoride halide-containing electrolytes which are applicable in the invention include those containing a chloride, bromide or iodide anion. Preferred electrolytes are those containing a bromide ion.

The cation of the electrolyte can be hydrogen or any metal from group I or group II of the Periodic Table or ammonium-type cations including those of lithium, sodium, potassium, calcium, ammonium, or tetralkylammonium, wherein the alkyl groups are independently linear or branched and contain 1 to 18 carbon atoms. Representative examples of non-fluoride halide-containing electrolytes which are applicable in the invention include lithium chloride, lithium bromide, lithium iodide, sodium chloride, sodium bromide, potassium chloride, potassium bromide, potassium iodide, ammonium chloride, ammonium bromide, ammonium iodide, tetrabutylammonium bromide, trimethyloctadecylammonium bromide, hydrogen chloride, hydrogen bromide, and the like. Preferred electrolytes in the process are lithium bromide and ammonium bromide.

The electrolyte is usually used in an amount of about 0.01 to 10 weight percent based on the weight of alcohol used. A preferred amount is usually about 1 to 10 weight percent of electrolyte based on the weight of alcohol used.

Optionally, if desired, the process can be initiated with a small amount, usually about 1 to 10 weight percent of the alcohol used, of an elemental halogen, preferably bromine. In such case, an auxiliary non-halide containing electrolyte can be used to provide the required conductivity in the liquid medium. If such an auxiliary electrolyte is used, it is usually used in an amount of about 1 to 10 weight percent of the alcohol used.

Carbon monoxide may be generally introduced into the liquid reaction medium by conducting the electrolysis in an atmosphere of carbon monoxide under pressure. Although it is not measured, it is assumed that the liquid reaction medium is saturated or near the saturation level of carbon monoxide, at the given pressure, prior to the electrolysis.

The electrolysis is usually conducted under carbon monoxide at a pressure of about 1 atmosphere or higher. Pressures of up to about 350 atmospheres and greater may also be effectively employed. Increased pressure results in a greater solubility of the carbon monoxide in the reaction medium and usually it is preferred to conduct the electrolysis under carbon monoxide atmosphere at a pressure of about 10 to 200 atmospheres.

The temperature of the electrolysis is usually carried out at a temperature above the freezing point and below the boiling point of the liquid medium. In general, lower temperatures result in high yields of carbonate and low yields of by-products in the reaction mixture such as formates, acetals and the like. In general, the process is preferably conducted at a temperature in the range of about 0° C. to about 100° C.

Anodes which are applicable in the process include those made from materials which are reasonably stable under the electrolysis conditions. Representative examples of suitable anodes include graphite, platinum, and noble metal activated titanium and tantalum metals, including, for example, those described in DOS 2,136,391 (1972). A preferred anode for use in the process is graphite, when bromide is employed in the electrolyte and noble metal activated titanium and tantalum metals when chloride is employed in the electrolyte.

Cathodes which are applicable in the process include those made from high, medium or low hydrogen overpotential materials. The term "hydrogen overpotential" is a term well-known in the art and refers to the actual potential at which hydrogen gas is produced by the reduction of hydrogen ion in solution, as opposed to the calculated theoretical value. Medium and low hydrogen overpotential cathodes are preferred to ensure that hydrogen evolution is the major reduction process that occurs in the solution during electrolysis, and that reduction of organic materials such as the product carbonates is inhibited. Cathodes applicable in the process must be stable under the reaction conditions, and representative examples include stainless steel, platinum, graphite and lead. A preferred cathode for use in the process is stainless steel.

Current densities used in the process are generally in the range of about 10 to 500 $mA/cm^2$, although lower and higher current densities may also be used effectively in obtaining high yields of organic carbonates.

Current efficiencies for the production of carbonates in the process are generally in the range from about 10 to 90%. By the term "current efficiency" is meant the actual product produced expressed as a percentage of the expected theoretical amount of product per Faraday of current passed, wherein a Faraday is equal to 96,500 coulombs, the electric current needed to deposit or dissolve one gram equivalent weight of a substance at an electrode.

The electrochemical apparatus employed in the reaction can be of any conventional type utilizing the cathodes and anodes described herein. It is preferred to use a high pressure container vessel such that the electrolysis can be conducted under pressure.

The electrolysis can be conducted in a one or two compartment cell assembly with equivalent results. In a one-compartment assembly, the anode and cathode are immersed in the electrolysis solution, and the resulting solution, after electrolysis is homogeneous. However, it is preferred under certain conditions, i.e., at low cathodic current densities in the liquid medium, or the use of high hydrogen overpotential metals as the cathode, to separate the cathode from the organic products in solution to avoid subsequent reduction. This can be accomplished by the use of a membrane to separate the cathode and anode compartments. The membrane, which only allows small cations to pass through, such as hydrogen ion and ammonium ion, does not allow formed carbonate to pass into the cathode chamber. Any conventional type membrane such as a cation exchange membrane or semipermeable membrane, may be used in the process.

The current in the assembly is a direct current usually supplied from a conventional direct current source.

A particularly preferred embodiment of the invention process is wherein a direct electric current is passed between an anode and cathode immersed in a solution containing methanol and about 1 to 10 weight percent, based on the amount of methanol, of a bromide-containing electrolyte, in an atmosphere of carbon monoxide, at a temperature of about 20° to 60° C., and under a pressure from about 10 to 200 atmospheres.

The following examples illustrate the best mode of carrying out the invention as contemplated by us, but should not be construed as being limitations on the scope or spirit of the instant invention.

EXAMPLE 1

A stainless steel, high pressure, electrolytic cell having a capacity of 300 ml was used in which the stainless steel cell served as the cathode and also as the container for the solution to be electrolyzed. A graphite rod which could be fitted into the cell served as the anode. A cation exchange membrane (IONICS 61/DYG 067) was used to separate the cathode and anode portions of the cell. The cell was charged with 3.5 g. (0.04 mol) of lithium bromide electrolyte and 200 ml commercial anhydrous methanol and the contents were pressurized with carbon monoxide to about 1500 psi. The electrolysis was carried out by passing a constant current of 5 amps through the cell, at room temperature, until 0.54 Faradays were passed.

The current for the electrolysis was supplied by a Hewlett-Packard, 6264B DC Power Supply, and the amount of charge passed was monitored by a current integrator (Model 1002, Curtis Instrument, Inc.). During the electrolysis, the solution was maintained at room temperature by means of a cooling water circulating coil. At the end of the electrolysis, the contents were analyzed by gas chromatography and mass spectrometry. The results indicated that 15 grams of dimethyl carbonate were formed, corresponding to 27 grams of dimethyl carbonate formed per Faraday, which, assuming a two electron process, corresponds to a current efficiency of about 60%. Methane, hydrogen and some carbon dioxide were also found as by-products. Dimethyl carbonate was isolated and its identity confirmed by infrared spectrophotometry.

EXAMPLE 2

The same procedure and equipment of Example 1 was used, except that the cation exchange membrane was not employed. A total of 6.6 g. of dimethyl carbonate was formed, corresponding to a current efficiency of about 15%.

EXAMPLE 3

The same procedure and equipment of Example 1 was used, except that ammonium bromide (4.0 g., 0.04 mol) was employed in place of lithium bromide as the electrolyte, and a total of 0.48 Faradays was passed. The results indicated that about 14 g. of dimethyl carbonate was formed corresponding to 30 g. of dimethyl carbonate produced per Faraday, corresponding to a current efficiency of about 67%.

EXAMPLE 4

The same procedure and equipment of Example 1 was used, except that a stainless steel rod cathode and graphite anode liner inside the stainless steel container were employed; the cation exchange membrane was not used, and ammonium bromide (4.0 g., 0.04 mol) was employed in place of lithium bromide as the electrolyte. A total of 0.45 Faradays were passed producing 31.5 g. of dimethyl carbonate per Faraday, corresponding to a current efficiency of about 70%.

EXAMPLE 5

The same procedure and equipment of Example 4 was used except that 4 g. (0.06 mol) tetrabutylammonium bromide was employed in place of ammonium bromide as the electrolyte. A total of 0.45 Faradays was passed producing 11.7 g. of dimethyl carbonate per Faraday, corresponding to a current efficiency of about 26%. In addition, trace amounts of methylal (dimethoxymethane) and methyl formate by-products were formed.

EXAMPLE 6

The same procedure and equipment of Example 5 was used except that 25 ml concentrated hydrochloric acid and 175 ml. of methanol were employed. Dimethyl carbonate was formed in an amount of 9 g. per Faraday, corresponding to a current efficiency of about 20%. In addition, methyl formate and methylal by-products were also formed.

EXAMPLE 7 (COMPARISON)

The same procedure and equipment of Example 1 was used except that lithium perchlorate (6.5 g., 0.06 mols) was used in place of lithium bromide. No detachable dimethyl carbonate was formed. Detectable products included methyl formate and methylal.

EXAMPLE 8

The same procedure and equipment of Example 1 was used, except sodium iodide (6.0 g., 0.04 mol) was employed instead of lithium bromide as the electrolyte. A total of 0.16 Faradays was passed yielding 20 g. of dimethyl carbonate per Faraday, corresponding to a current efficiency of about 45%. Methylal was also formed.

EXAMPLE 9

The same procedure and equipment of Example 1 was used, except lithium chloride (2.0 g., 0.05 mol) was used instead of lithium bromide as the electrolyte. A total of 18.5 g. dimethyl carbonate was formed per Faraday, corresponding to a current efficiency of about 14%. Methylal was also formed.

EXAMPLE 10 (COMPARISON)

The same procedure and equipment of Example 4 was used, except that ammonium nitrate (10 g., 0.125 mol) was used instead of ammonium bromide as the electrolyte. No dimethyl carbonate product was detected. However, minor amounts of methyl formate and methylal were present in the reaction mixture.

EXAMPLE 11

The same procedure and equipment of Example 10 was used, except that 2 ml. bromine was added to the alcohol solution. Dimethyl carbonate was formed in an amount of 26 g. per Faraday, corresponding to a current efficiency of about 58%. Small amounts of methylal were also produced.

EXAMPLE 12

The same equipment of Example 4 was used. The cell was charged with 200 g. ethylene glycol and 10 g. $NH_4Br$ and the cell contents placed under a carbon monoxide pressure of about 1500 psi, at 20°-30° C. A total of 0.67 Faradays were passed. The results indicated that ethylene carbonate was formed in a current efficiency of about 5-10%. Formation of some other unidentified by-products was also observed.

EXAMPLE 13

The same procedure and equipment of Example 12 were used except a mixture of 160 g. ethylene glycol, 40 g. methanol and 4.0 g. $NH_4Br$ was used as the liquid reaction medium in the electrolysis. A total of 0.61 Faradays were passed at a temperature of about 20°-30° C. Results indicated that dimethyl carbonate was formed in 25% current efficiency and ethylene carbonate formed in a 45% current efficiency. No other detectable by-products were formed.

We claim:

1. A process for preparing non-polymeric organic carbonates comprising passing a direct electric current between an anode and cathode immersed in a liquid medium consisting essentially of a non-fluoride halide-containing electrolyte, carbon monoxide and a paraffinic monohydric or 1,2-dihydric alcohol, or mixture thereof, at a temperature below the boiling point of the liquid medium, and under an atmosphere consisting essentially of carbon monoxide.

2. A process of claim 1 wherein the organic carbonate has the following formulas:

(1) RO—CO—OR', where R and R' are independently selected from linear or branched $C_1$-$C_{18}$ alkyl; and (2)

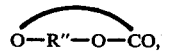

where R'' is $—CH_2—CH_2—$ or $—CH_2—CH(CH_3)—$, and wherein said alcohol containing aforesaid R and R' radicals may contain other substituents which are inert under the reaction conditions.

3. The process of claim 1 wherein said alcohol is selected from the group consisting of methanol, ethanol, ethylene glycol, and 1,2-propylene glycol.

4. The process of claim 3 wherein said alcohol is methanol or ethylene glycol.

5. The process of claim 1 wherein said electrolyte contains a chloride, bromide or iodide ion.

6. The process of claim 5 wherein said halide ion is bromide ion.

7. The process of claim 1 wherein said electrolyte contains a cation selected from hydrogen, lithium, sodium, potassium, ammonium or tetraalkylammonium, wherein the alkyl groups are independently linear or branched and contain 1 to 18 carbon atoms.

8. The process of claim 1 wherein said electrolyte is lithium bromide, ammonium bromide, hydrogen bromide or hydrogen chloride.

9. The process of claim 1 wherein said electrolyte is present in about 0.01 to 10 weight percent based on the weight of said alcohol present.

10. The process of claim 1 conducted in the temperature range of about 0° to 100° C.

11. The process of claim 1 conducted under a carbon monoxide atmosphere at a pressure of about 1 to about 350 atmospheres.

12. The process of claim 1 wherein said cathode is a stable medium or low hydrogen overpotential metal, alloy or non-metallic conductor.

13. The process of claim 12 wherein said cathode is stainless steel.

14. The process of claim 1 wherein the anode is graphite, platinum, or noble metal activated titanium or tantalum.

15. The process of claim 14 wherein said anode is graphite.

16. The process of claim 1 wherein the current density is about 10 to 500 $mA/cm^2$.

17. The process of claim 1 wherein a direct electric current is passed between an anode and cathode immersed in a solution containing methanol and about 1 to 10 weight percent of a bromide-containing electrolyte, based on the amount of methanol, at a temperature of about 20° to 60° C., and under a carbon monoxide atmosphere at a pressure from about 10 to 200 atmospheres.

18. The process of claim 1 wherein said liquid medium further comprises an inert reaction solvent having good solvency for the alcohol.

* * * * *